US007766505B2

(12) United States Patent
Tseng et al.

(10) Patent No.: US 7,766,505 B2
(45) Date of Patent: Aug. 3, 2010

(54) LIGHT SOURCE ASSEMBLY

(75) Inventors: Chin-Feng Tseng, Chu-Nan (TW); Chih-Ming Lai, Chu-Nan (TW)

(73) Assignee: Foxsemicon Integrated Technology, Inc., Chu-Nan, Miao-Li Hsien (TW)

( * ) Notice: Subject to any disclaimer, the term of this patent is extended or adjusted under 35 U.S.C. 154(b) by 0 days.

(21) Appl. No.: 12/202,577

(22) Filed: Sep. 2, 2008

(65) Prior Publication Data

US 2009/0190350 A1 Jul. 30, 2009

(30) Foreign Application Priority Data

Jan. 28, 2008 (CN) ..... 2008 1 0300241

(51) Int. Cl.
*F21V 21/00* (2006.01)

(52) U.S. Cl. ..... 362/217.17; 362/217.13; 362/249.11

(58) Field of Classification Search ..... 362/97.1, 362/97.3, 217.01, 217.12, 217.13, 217.16, 362/217.17, 224, 225, 241, 249.01, 249.02, 362/249.11, 253, 294, 368, 373, 800, 812; 345/1.3; 257/88, 98, 668, 706, 707
See application file for complete search history.

(56) References Cited

U.S. PATENT DOCUMENTS

| | | | | |
|---|---|---|---|---|
| 4,302,800 | A * | 11/1981 | Pelletier | 362/249.11 |
| 5,420,769 | A * | 5/1995 | Ahlgren et al. | 362/294 |
| 5,600,910 | A * | 2/1997 | Blackburn | 40/605 |
| 5,660,461 | A * | 8/1997 | Ignatius et al. | 362/241 |
| 6,881,946 | B2 * | 4/2005 | Cok et al. | 250/208.6 |
| 7,307,823 | B2 * | 12/2007 | Dabrowski et al. | 361/118 |
| 7,355,562 | B2 * | 4/2008 | Schubert et al. | 345/1.3 |
| 2007/0058377 | A1 | 3/2007 | Zampini et al. | |

FOREIGN PATENT DOCUMENTS

| | | |
|---|---|---|
| DE | 202004003503 U | 6/2004 |
| EP | 0110348 A1 | 6/1984 |
| TW | M309124 | 4/2007 |
| WO | WO 8801710 | 3/1988 |

* cited by examiner

*Primary Examiner*—Hargobind S Sawhney
(74) *Attorney, Agent, or Firm*—Andrew C. Cheng

(57) ABSTRACT

A light source assembly includes a first and a second light source modules. The first light source module includes a first light source, a first heat-dissipating base, and a first connecting part. The first heat-dissipating base has a first side and a second side. The first light source is mounted on the first side of the first heat-dissipating base, and the first connecting part extends outwardly from the second side of the first heat-dissipating base. The second light source module includes a second light source, a second heat-dissipating base, and a second connecting part. The second heat-dissipating base has a first side and a second side. The second light source is mounted on the first side of the second heat-dissipating base, and the second connecting part extends outwardly from the second side. The first connecting part is detachably and slidably engaged with the second connecting part.

18 Claims, 5 Drawing Sheets

LIGHT SOURCE ASSEMBLY

CROSS-REFERENCE TO RELATED APPLICATIONS

This application is related to the commonly-assigned copending application: Ser. No. 12/177,424, entitled "ILLUMINATION DEVICE". The Disclosure of the above-identified application is incorporated herein by reference.

BACKGROUND

1. Technical Field

The present invention relates to a light source assembly, and particularly, to a light source assembly capable of large-area illumination.

2. Description of Related Art

Light source modules, such as incandescence lamps, fluorescent lamps and halogen lamps, generally have a limited illumination area. However, it is not adequate to use these light source modules in certain areas, such as stadiums and stages, where a large-area illumination is needed.

In order to illuminate a large area, a plurality of light source modules can be used simultaneously, each of which works independently. However, since the light source modules are arranged independently, it can be difficult and troublesome to install.

Therefore, a new light source assembly is desired to overcome the above mentioned problems.

SUMMARY

An exemplary light source assembly includes a first light source module and a second light source module. The first light source module includes a first light source, a first heat-dissipating base, and a first connecting part. The first heat-dissipating base has a first side and an opposite second side. The first light source is mounted on the first side of the first heat-dissipating base, and the first connecting part extends outwardly from the second side of the first heat-dissipating base. The second light source module includes a second light source, a second heat-dissipating base, and a second connecting part. The second heat-dissipating base has a first side and an opposite second side. The second light source is mounted on the first side of the second heat-dissipating base, and the second connecting part extends outwardly from the second side of the second heat-dissipating base. The first connecting part is detachably and slidably engaged with the second connecting part.

BRIEF DESCRIPTION OF THE DRAWINGS

Many aspects of the embodiments can be better understood with references to the following drawings. The components in the drawings are not necessarily drawn to scale, the emphasis instead being placed upon clearly illustrating the principles of the present embodiments. Moreover, in the drawings, like reference numerals designate corresponding parts throughout the several views.

DETAILED DESCRIPTION OF THE EMBODIMENTS

Embodiments will now be described in detail below with references to the drawings.

Figure 1:
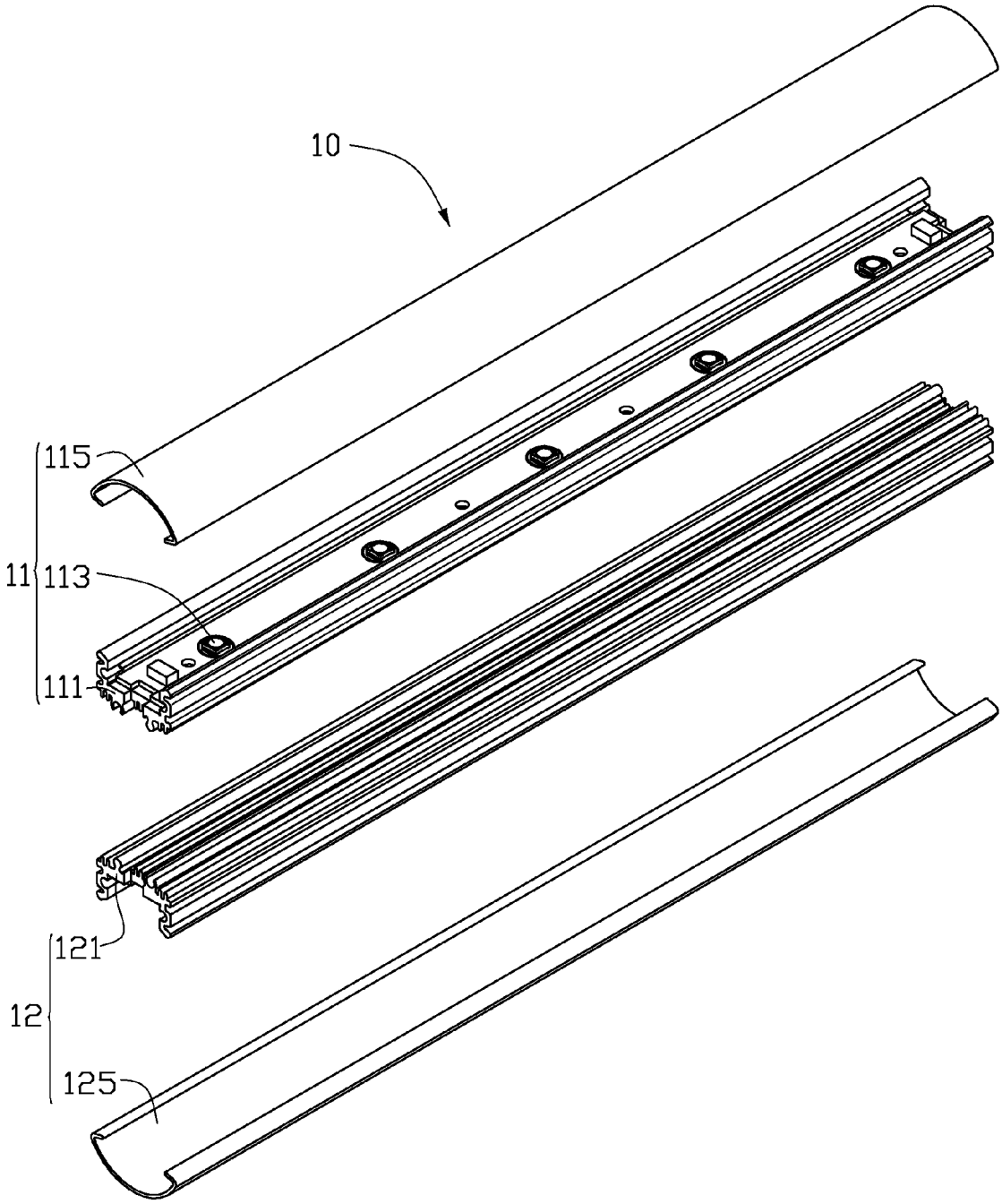
FIG. 1 is an exploded perspective view of a light source assembly according to a first embodiment.
Figure 2:
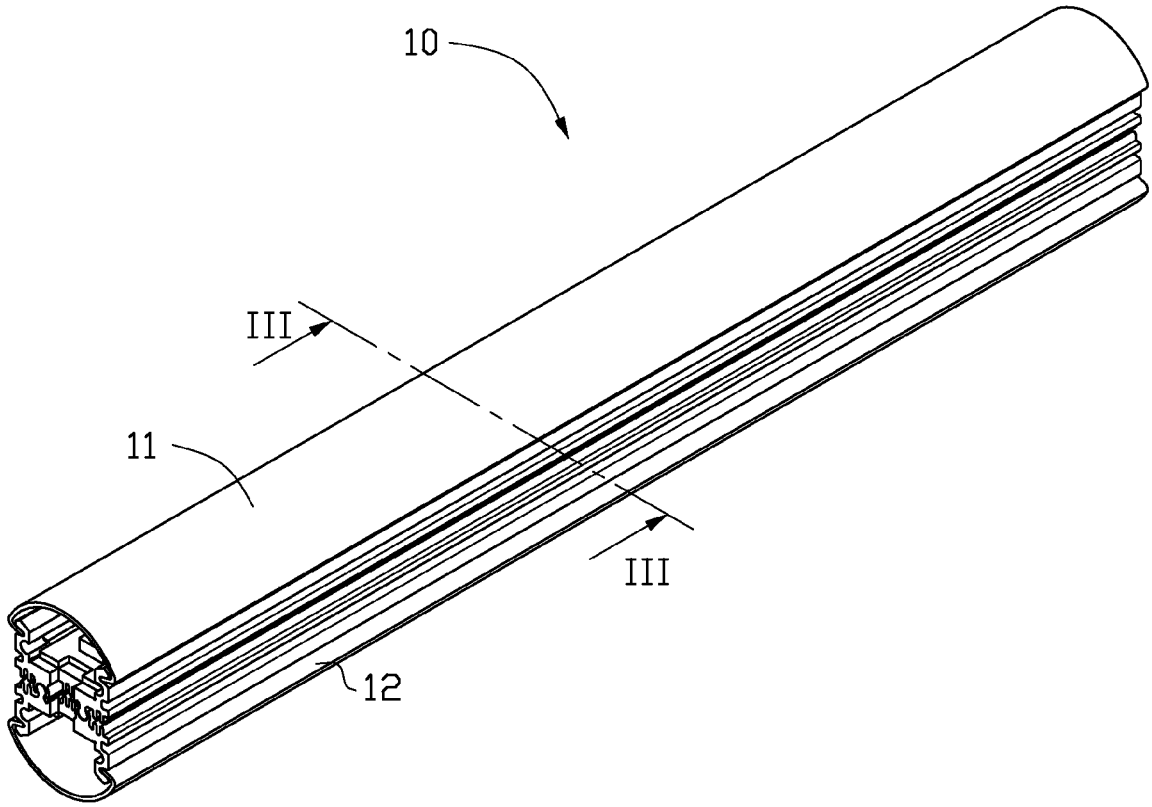
FIG. 2 is a perspective view of the assembled light source assembly of FIG. 1.

Referring to FIGS. 1-2, a light source assembly 10 includes a first light source module 11 and a second light source module 12. The first light source module 11 faces away from the second light source module 12.

Figure 3:
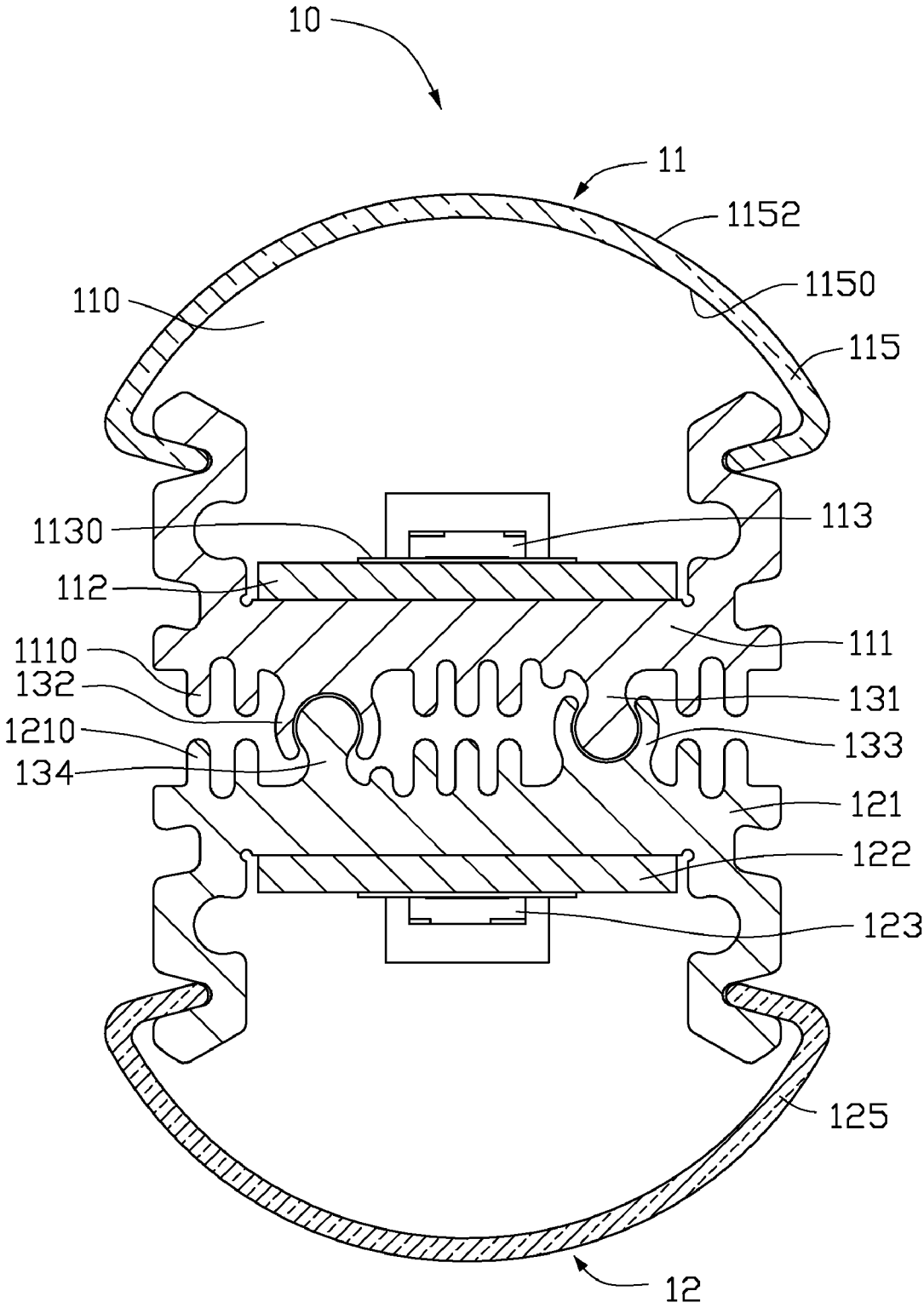
FIG. 3 is a side, cross-sectional view of the assembled light source assembly of FIG. 2 taken along the line III-III thereof.

Referring to FIGS. 1-3, the first light source module 11 is elongated. The first light source module 11 includes a heat-dissipating base 111, a circuit board 112, a light source 113 disposed in the heat-dissipating base 111, a light pervious cover 115, a first connecting part 131 and a second connecting part 132. The light source 113 can include at least one light emitting diode (LED). The light source 113 can be attached to the circuit board 112 via a thermally conductive adhesive 1130, for example, a silver colloid. The circuit board 112 is mounted on the heat-dissipating base 111 so that the light source 113 is thermally connected with the heat-dissipating base 111. The heat generated from the light source 113 is conveyed to the heat-dissipating base 111, subsequently dissipating in air. The light source 113 can be mounted on the circuit board 112 via eutectic sintering or soldering with solder balls.

The heat-dissipating base 111 includes a plurality of heat-dissipating fins 1110 extending outwardly in a direction away from the light source 113. The heat-dissipating fins 1110 increase a contact area between the heat-dissipating base 111 and the air to dissipate the heat generated by the light source 113 more efficiently. The heat-dissipating base 111 can be made of metal with a high thermal conductivity, for example, aluminum, copper, or stainless steel.

The first connecting part 131 and the second connecting part 132 extend outwardly from the heat-dissipating base 111. The first connecting part 131 has a substantially circular cross-section, while the second connecting part 132 is a substantially elongated C-shaped protrusion. The first connecting part 131 has an outline of an arc in cross-section, while the second connecting part 132 is substantially C-shaped in cross-section. The second connecting part 132 defines a substantially elongated cylindrical groove therein. The first connecting part 131 and the second connecting part 132 both have an outline of a major arc in their respective cross-sections.

The light pervious cover 115 and the heat-dissipating base 111 cooperatively define an accommodating space 110 therein for receiving the light source 113. The light pervious cover 115 includes a light incident surface 1150 and an opposite light emitting surface 1152. The light emitted from the light source 113 reaches the light incident surface 1150, passes through the light pervious cover 115, and then emits out from the light emitting surface 1152. The light emitting surface 1152 can be a smooth or rough surface. In the present embodiment, the light emitting surface 1152 is a rough surface. After the light emitted from the light source 113 transmits through the light pervious cover 115, the light emits uniformly from the light emitting surface 1152. Therefore, the light emitted from the first light source module 11 is softer and less irritant to the human eye. The light cover 115 can have a plurality of light converging lenses or light diverging lenses formed on the light emitting surface 1152 for converging or diverging the light emitted from the light source 113, depending on the application and usage requirements. The light pervious cover 115 can be made of transparent material. Particularly, the light pervious cover 115 can be made of hard transparent material so that the light pervious cover 115 protects the light source 113 from damage. The hard transparent material can be polymethyl methacrylate (PMMA), poly carbonate (PC), silicone, epoxy, or polyacrylate.

The second light source module 12 faces away from the first light source module 11. Similar to the first light source module 11, the second light source module 12 includes a heat-dissipating base 121, a light source 123 attached to the heat-dissipating base 121, a light pervious cover 125, a third connecting part 133, and a fourth connecting part 134. Both the third connecting part 133 and the fourth connecting part 134 extend outwardly from the heat-dissipating base 121. Similar to the second connecting part 132, the third connecting part 134 is a substantially elongated C-shaped protrusion; similar to the first connecting part 131, the fourth connecting part 134 has a substantially circular cross-section. The second connecting part 132 defines a substantially elongated cylindrical groove therein.

In assembly, one end of the first connecting part 131 is aligned with one end of the third connecting part 133, while one end of the second connecting part 132 is aligned with one end of the fourth connecting part. Subsequently, the first light source module 10 slides along the lengthwise direction of the second light source module 12 relative to the second light source module 12 until the first connecting part 131 is entirely received in the groove of the second light source module 12 and the fourth light source module 134 is entirely received in the groove of the second light source module 132. In this position, the first light source module 11 and the second light source module 12 are back-to-back. The first light source module 11 and the second light source module 12 are slidably and detachably engaged with each other.

Figure 4:
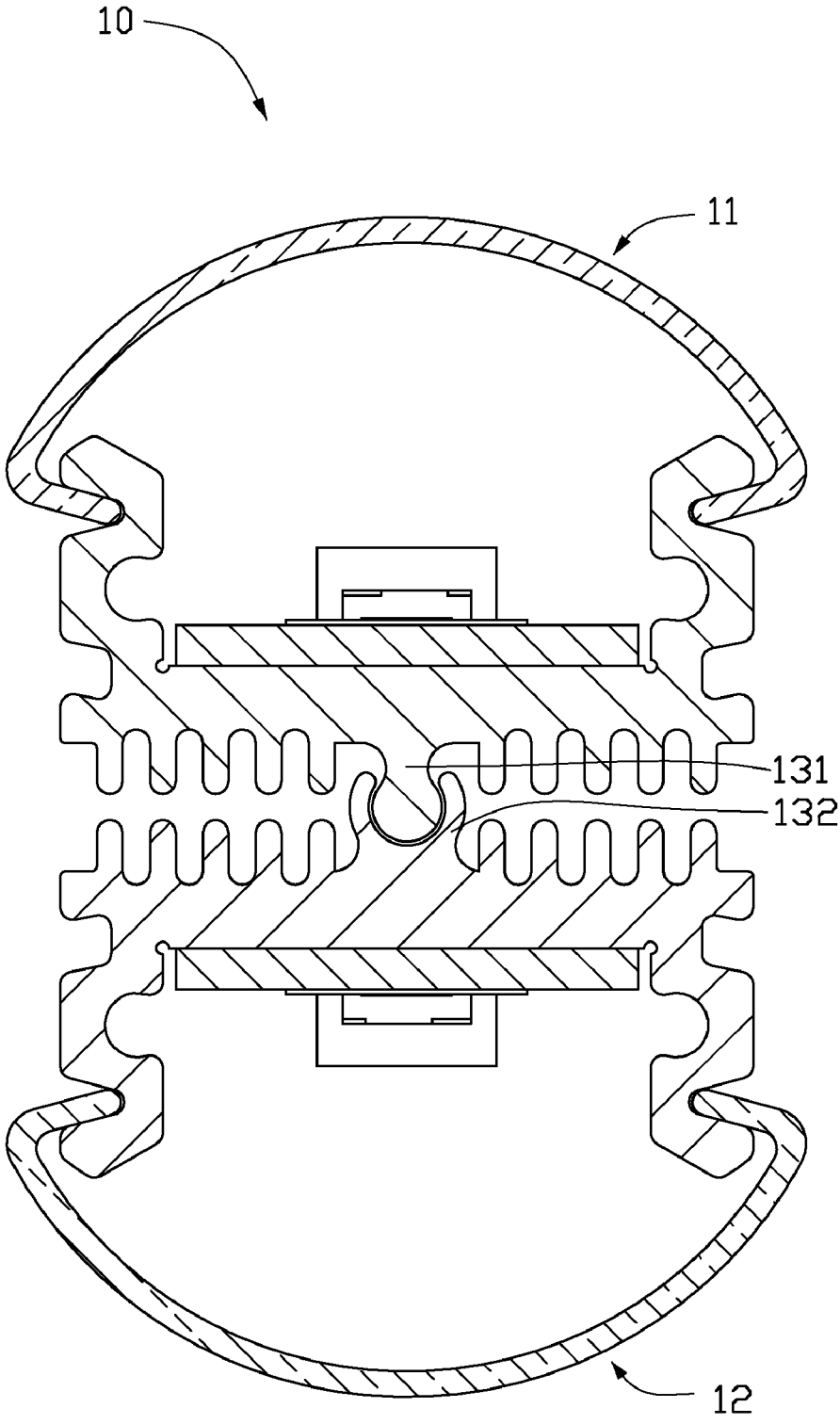
FIG. 4 is a side, cross-sectional view of an assembled light source assembly according to a second embodiment.

Referring to FIG. 4, a light source assembly 10 according to a second embodiment is shown. The light source assembly 10 of the present embodiment is similar to that of the first embodiment, with the exception that the first light source module 11 includes only one first connecting part 131 and the second light source module 12 includes only one second connecting part 132. The first light source module 11 is capable of rotating a predetermined angle (e.g., from 0 degrees to 15 degrees) around a central axis of the first connecting part 131 relative to the second light source module 12.

Figure 5:
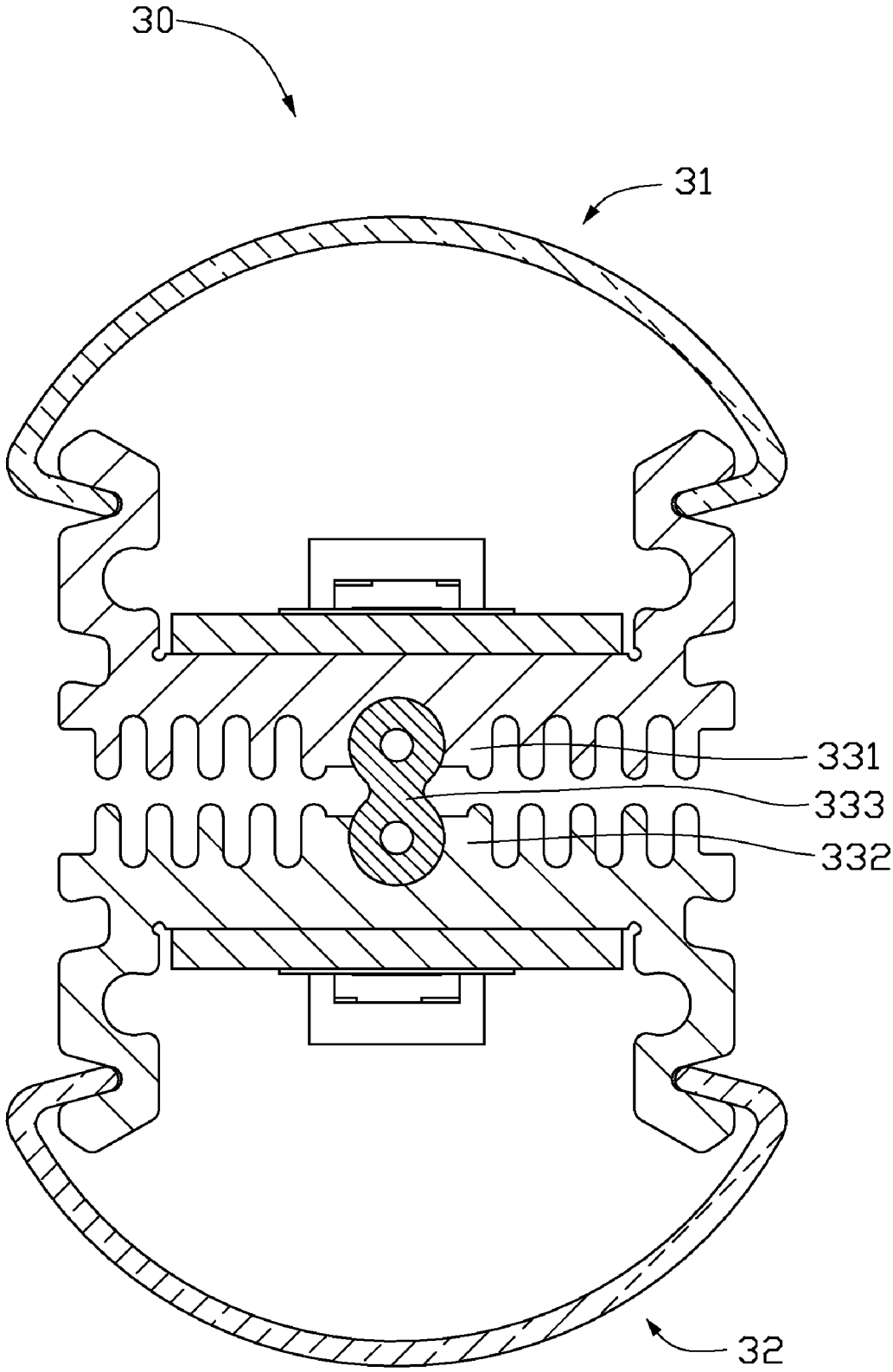
FIG. 5 is a side, cross-sectional view of an assembled light source assembly according to a third embodiment.

Referring to FIG. 5, a light source assembly 30 according to a third embodiment is shown. The light source assembly 30 includes a first light source module 31, a second light source module 32, and a connecting shaft 333 connected between the first light source module 31 and the second light source module 32. The connecting shaft 333 is slidably and detachably coupled to the first light source module 31 and the second light source module 32. Similar to the first light source module 11 of the first embodiment, the first light source module 31 includes a first connecting part 331, while the second light source module 32 includes a second connecting part 332. The first connecting part 331 is similar to the second connecting part 132 of FIG. 3 according to the first embodiment. The first connecting part 331 defines a substantially elongated cylindrical groove therein. The second light source module 32 has the same shape as the first light source module 31. The second connecting part 332 defines a substantially elongated cylindrical groove therein. The connecting shaft 333 includes two interconnected parallel cylinders that are integrally formed. The connecting shaft 333 has an outline of an Arabic numeral "8". After the light source assembly 30 has been assembled, each cylinder of the connecting shaft 333 is partly received in a corresponding cylindrical groove of the first connecting part 331 and the second connecting part 332. The first light source module 31 is capable of rotating a predetermined angle (e.g., from 0 degrees to 15 degrees) around a central axis of the connecting shaft 333 relative to the second light source module 12.

While certain embodiments have been described and exemplified above, various other embodiments from the foregoing disclosure will be apparent to those skilled in the art. The present invention is not limited to the particular embodiments described and exemplified but is capable of considerable variation and modification without departure from the scope of the appended claims.

What is claimed is:

1. A light source assembly comprising:

a first light source module comprising a first heat-dissipating base, a first light source, and a first connecting part, the first heat-dissipating base having a first side and an opposite second side, the first light source being mounted on the first side of the first heat-dissipating base, the first connecting part extending outwardly from the second side of the first heat-dissipating base; and a second light source module comprising a second heat-dissipating base, a second light source, and a second connecting part, the second heat-dissipating base having a first side and an opposite second side, the second light source being mounted on the first side of the second heat-dissipating base, the second connecting part extending outwardly from the second side of the second heat-dissipating base, the first connecting part being detachably and slidably engaged with the second connecting part, wherein the first connecting part comprises a protrusion, the second connecting part defines a groove therein, and the protrusion is received in the groove, the protrusion has a substantially circular cross-section, the second connecting part comprises a C-shaped protrusion, and the groove is defined in the C-shaped protrusion.

2. The light source assembly as claimed in claim 1, wherein the first connecting part has an outline of a major arc in cross-section, and the second connecting part has an outline of a major arc in cross-section.

3. The light source assembly as claimed in claim 1, further comprising a connecting shaft pivotedly coupled to the first connecting part and the second connecting part, the connecting shaft being slidably and detachably coupled to the first light source module and the second light source module.

4. The light source assembly as claimed in claim 3, wherein the first connecting part defines a first groove therein, the second connecting part defines a second groove therein, a first part of the connecting shaft is received in the first groove, and a second part of the connecting shaft is received in the second groove.

5. The light source assembly as claimed in claim 4, wherein the first connecting part comprises a C-shaped protrusion, the second connecting part comprises a C-shaped protrusion, the first groove is substantially cylindrical, the second groove is substantially cylindrical, and the connecting shaft comprises two interconnected parallel cylinders.

6. The light source assembly as claimed in claim 5, wherein the first connecting part has an outline of a major arc in cross-section, and the second connecting part has an outline of a major arc in cross-section.

7. The light source assembly as claimed in claim 1, wherein the first heat-dissipating base comprises a plurality of fins extending outwardly from the first heat-dissipating base.

8. The light source assembly as claimed in claim 1, wherein the first light source module comprises a first light emitting surface, the second light source module comprises a second light emitting surface, and the first and the second light emitting surfaces are arranged on opposite sides of the light source assembly, respectively.

9. A light source assembly comprising:

a first light source module comprising a first light emitting surface and a first connecting part; and a second light source module comprising a second light emitting surface and a second connecting part, the second light source module being detachably and slidably coupled to the first light source module via the first and the second connecting parts, the first light emitting surface and the second light emitting surface being arranged on opposite sides of the light source assembly, respectively, wherein the first light emitting surface and the second light emitting surface face away from each other, wherein the first connecting part comprises a protrusion, the second connecting part defines a groove therein, and the protrusion is received in the groove; and wherein the first connecting part has a substantially circular cross-section, the second connecting part comprises a C-shaped protrusion in cross-section, and the groove is defined in the C-shaped protrusion.

10. The light source assembly as claimed in claim 9, wherein the first connecting part has an outline of a major arc in cross-section, and the second connecting part has an outline of a major arc in cross-section.

11. The light source assembly as claimed in claim 9, further comprising a connecting shaft pivotedly coupled to the first connecting part and the second connecting part, the connecting shaft being slidably and detachably coupled to the first light source module and the second light source module.

12. The light source assembly as claimed in claim 11, wherein the first connecting part defines a first groove therein, the second connecting part defines a second groove therein, a first part of the connecting shaft is received in the first groove and a second part of the connecting shaft is received in the second groove.

13. The light source assembly as claimed in claim 12, wherein the first connecting part comprises a C-shaped protrusion in cross-section, the second connecting part comprises a C-shaped protrusion in cross-section, the first groove is substantially cylindrical, the second groove is substantially cylindrical, and the connecting shaft comprises two interconnected parallel cylinders.

14. The light source assembly as claimed in claim 9, wherein the first light emitting surface is rotatable about a rotating axis relative to the second light source module.

15. A light source assembly comprising:

a first light source module comprising a first heat-dissipating base, a first light source, and a first connecting part, the first heat-dissipating base having a first side and an opposite second side, the first light source being mounted on the first side of the first heat-dissipating base, the first connecting part extending outwardly from the second side of the first heat-dissipating base;

a second light source module comprising a second heat-dissipating base, a second light source, and a second connecting part, the second heat-dissipating base having a first side and an opposite second side, the second light source being mounted on the first side of the second heat-dissipating base, the second connecting part extending outwardly from the second side of the second heat-dissipating base, the first connecting part being detachably and slidably engaged with the second connecting part; and a connecting shaft pivotedly coupled to the first connecting part and the second connecting part, the connecting shaft being slidably and detachably coupled to the first light source module and the second light source module.

16. The light source assembly as claimed in claim 15, wherein the first connecting part defines a first groove therein, the second connecting part defines a second groove therein, a first part of the connecting shaft is received in the first groove, and a second part of the connecting shaft is received in the second groove.

17. The light source assembly as claimed in claim 16, wherein the first connecting part comprises a C-shaped protrusion, the second connecting part comprises a C-shaped protrusion, the first groove is substantially cylindrical, the second groove is substantially cylindrical, and the connecting shaft comprises two interconnected parallel cylinders.

18. The light source assembly as claimed in claim 17, wherein the first connecting part has an outline of a major arc in cross-section, and the second connecting part has an outline of a major arc in cross-section.

* * * * *